United States Patent [19]

Opresko et al.

[11] Patent Number: 4,902,023

[45] Date of Patent: Feb. 20, 1990

[54] VACUUM SEALING GASKET

[75] Inventors: Stephen T. Opresko, Lancaster; Walter E. Root, Strasburg, both of Pa.

[73] Assignee: Thomson Consumer Electronics, Indianapolis, Ind.

[21] Appl. No.: 283,441

[22] Filed: Dec. 12, 1988

[51] Int. Cl.[4] ..... H01J 29/87

[52] U.S. Cl. ..... 277/12; 220/2.1 A; 277/205

[58] Field of Search ..... 220/231, 240, 353, 358, 220/378; 277/205, 215, 12, 49, 237 R

[56] References Cited

U.S. PATENT DOCUMENTS 3,912,104 10/1975 Schwartz ..... 220/2.1 A
4,054,913 10/1977 Lerner ..... 220/2.1 A
4,076,143 2/1978 Jenne, Jr. et al. ..... 220/2.1 R
4,210,935 7/1980 Mitchell et al. ..... 220/2.1 A
4,812,708 3/1989 Change ..... 220/2.1 A

*Primary Examiner*—Allan N. Shoap
*Assistant Examiner*—Jeffrey J. Hohenshell
*Attorney, Agent, or Firm*—J. S. Tripoli; D. H. Irlbeck; L. L. Hallacher

[57] ABSTRACT

A resilient, non-porous gasket for a substantially rectangular vacuum chamber includes an outer lip for positioning and holding the gasket on the support frame of the vacuum chamber. An improvement for enabling the gasket to creep during said gasket deformation and for enhancing the sealing of the sealing edge of an object being processed against a sealing surface of the gasket in the presence of curvature of the sealing edge wherein the corners of the outer lip of the gasket are removed.

4 Claims, 3 Drawing Sheets

VACUUM SEALING GASKET

BACKGROUND

This invention relates generally to the production of kinescopes and particularly to a gasket for sealing kinescope faceplates having out-of-flat sealing edges onto a vacuum chamber.

The production of color television picture tubes (kinescopes) is a very complex procedure employing literally hundreds of processing steps. Among the processing steps are those of producing a phosphor screen on the inside surface of a faceplate panel. The phosphor screen includes three different phosphors each of which produces one of the primary colors of light when impacted by electrons. The phosphor layer is coated with a layer of organic compound which provides a smooth surface so that a thin layer of aluminum can be applied to the screen. The aluminum coating is used to electrically connect the phosphor screen to a selection electrode (shadow mask) which causes each of three electron beams to impact the phosphor of the proper light emitting color. The aluminum layer also reflects light which is generated in the phosphor, but which is directed toward the interior of the tube, toward the viewer to enhance the brightness of the light from the screen.

The aluminum layer is applied to the screen of the panel by placing the panel over the open end of a vacuum chamber. The vacuum chamber is shaped and dimensioned in accordance with a particular model of faceplate panel. A support frame is arranged around the open end of the vacuum chamber to receive and support the panel. A resilient, non-porous gasket is arranged on the support frame to receive a seal edge of the panel. When the chamber is evacuated, atmospheric pressure pushes the seal edge of the panel onto a seal surface of the gasket to form an airtight seal between the gasket and the edge of the panel. As the edge of the panel presses into the gasket, the gasket deforms and the gasket material must be able to move, or creep, on the support frame to compensate for the dimensional change caused by the deformation. Typically, the need for the gasket to creep is no problem because the seal edge of the panel has very little curvature and, thus is sufficiently flat to require very little creep. Under these conditions, the seal edge is able to press against the seal surface of the gasket and form an airtight seal between the seal edge and the gasket. However, problems arise when the seal edges of the panels are curved, rather than straight, due to difficulty of forming glass, of which the panels are made. As the curvature of the seal edge increases, the depth to which the panel must push into the gasket material in order to form an air tight seal increases, the deformation of the gasket also increases. The increased deformation of the gasket material requires an increase in the ability of the gasket to creep, on-the support frame in order to form an air tight seal between the panel end gasket. With the prior art gasket, a panel edge curvature in the range of 10 mils, and above, prevents the formation of an air tight seal because of the limited amount of creep of the gasket. It is impossible to determine before hand whether or not a sufficiently airtight seal is formed prior to vaporizing the aluminum inside the vacuum chamber. The vaporization of the aluminum causes the aluminum to be deposited on the screen of the panel in the desired manner. However, when an effective airtight seal is not formed, some, or all, of the vaporized aluminum is oxidized and the aluminized coating on the phosphor screen is dark, and in many instances unacceptable. For these reasons there is a need for an improvement which permits an airtight seal to be formed between the gasket material and the seal edge of the panel even in the presence of substantial curvature of the seal edge. The present invention fulfills this need.

SUMMARY

A resilient, non-porous gasket for a substantially rectangular vacuum chamber has an outer lip for positioning the gasket on the support frame of the vacuum chamber. The gasket includes a sealing surface for receiving an object having a sealing edge which presses into and deforms the sealing surface when outside pressure presses the object into the sealing surface during evacuation of the vacuum chamber. An improvement for enabling the gasket to creep during the deformation of the gasket to enhance sealing between the sealing edge of the object and the sealing surface of the gasket in the presence of curvature of the sealing edge wherein the corners of the outer lip are removed.

DETAILED DESCRIPTION

Figure 1:
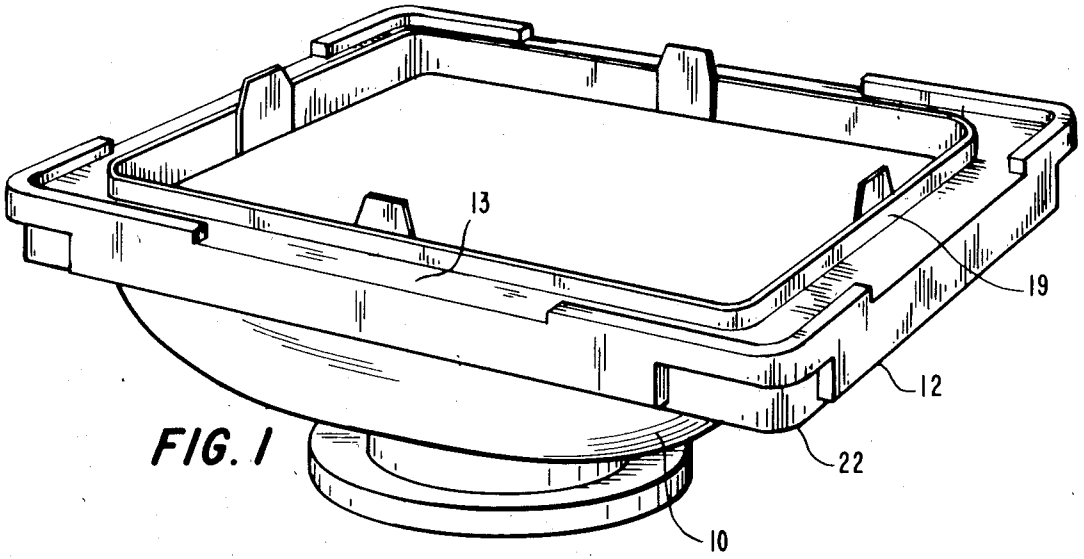
FIG. 1 is an isometric view of a preferred embodiment.
Figure 2:
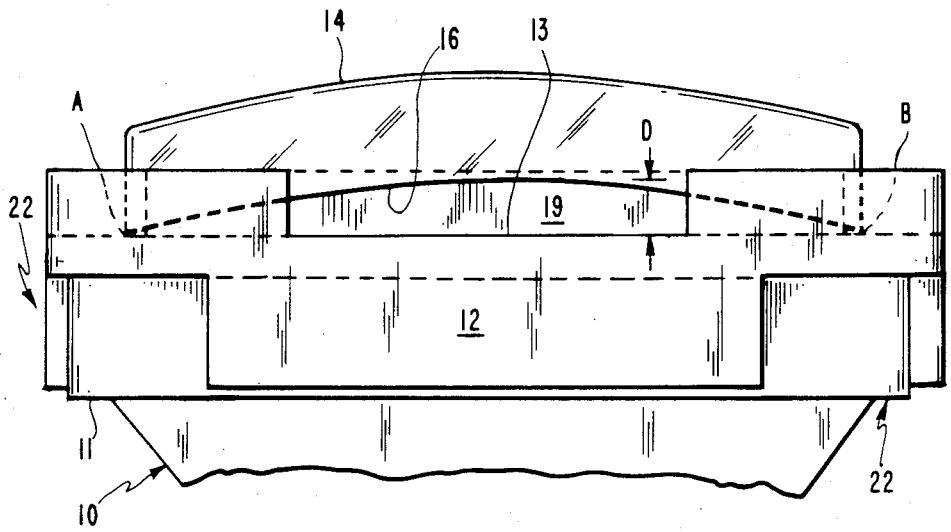
FIG. 2 shows how a curved faceplate seal edge can fail to seal with the gasket seal surface.

In FIGS. 1 and 2, a vacuum chamber 10 includes a support frame 11 upon which a sealing gasket 12 is placed. The gasket 12 is made of a resilient, non-porous material, such as rubber. The gasket 12 has a sealing surface 13 upon which a faceplate panel 14, the interior of which is to be aluminized, is placed. The panel 14 includes a seal edge 16, which when flat, rests flatly against the sealing surface 13. When the seal edge 16 includes a curvature, the seal surface 16 is spaced from the seal surface 13 of the gasket 12 by a distance D. Evacuation of the vacuum chamber 10 causes atmospheric pressure to act against the outside surface of the panel 14 and press the seal edge 16 of the panel 14 into the sealing surface 13 of the gasket 12. The pressing of the seal edge 16 into the surface 13 deforms the gasket material and forms an airtight seal between the edge 16 and the surface 13, even in the presence of some curvature of the panel seal edge 16, as indicated in FIG. 2. The gasket material is non-porous and therefor the deformation of the material causes the material to move, or creep, with respect to the frame 11.

Figure 3:
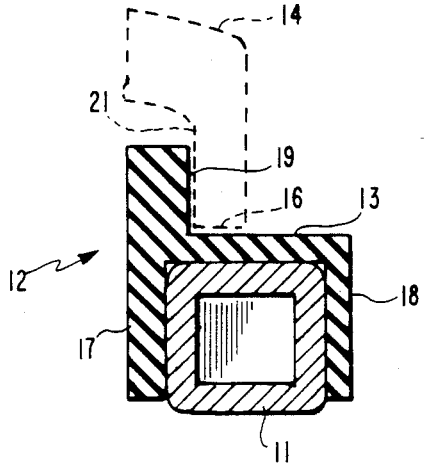
FIG. 3 is a cross section of the preferred embodiment of FIG. 1.

As shown in FIG. 3, the gasket 12 includes an inner lip 17 which covers the inside surface of the support frame 11 to shield the frame from the vaporized aluminum. An outer lip 18 serves to position the gasket 12 onto the support frame 11 and also helps keep the gasket on the frame. The gasket 12 also includes a guide and shield portion 19 which guides the inside wall 21 of the panel 14 onto the gasket to accurately position the panel on the vacuum chamber and to shield the inside wall 21 of the panel 14 from the vaporized aluminum.

Figure 4:
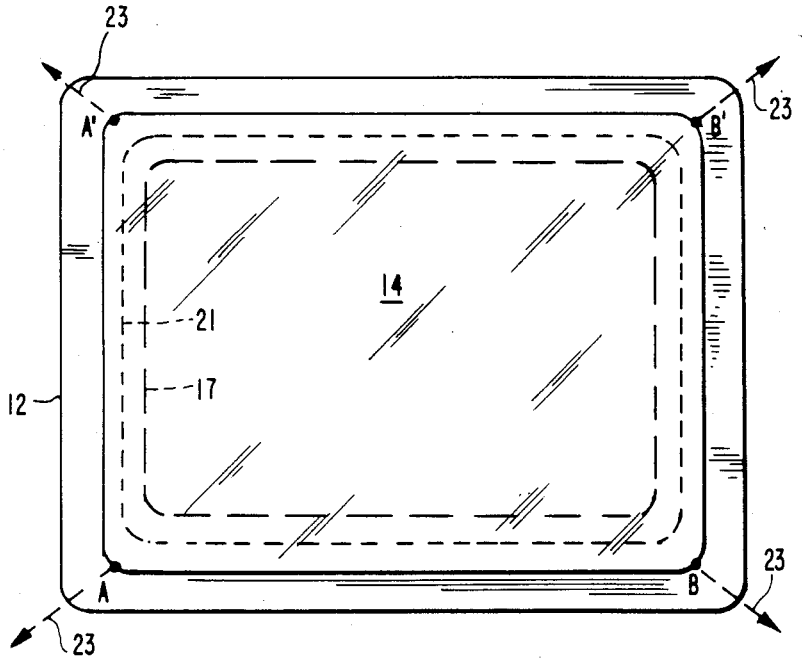
FIG. 4 is a top view showing how the gasket must move in order to form a seal in the presence of a curved seal edge on the panel.

As stated above, when the panel 16 passes into and deforms the gasket 12 the gasket material is pressed to be thinner and therefore the surface resting on frame 12 expands and must be able to creep on the support frame 11 in order to prevent the gasket from buckling. In the prior art the amount of creep possible is severely limited and therefore faceplate panels having a curvature D in excess of approximately 10 mils frequently do not seal tightly against the gasket, resulting in the unacceptable aluminization of the screen. With the invention, the amount of creep is maximized by removing the corners 22 of the outer lip 18 of the gasket 12. As shown in FIG. 1, the corners 22 of the support frame 11 are rounded. The outer lip 18 of the gasket 12 is removed for a short distance beyond the curved portion of the rounded corners. The manner in which the removal of the gasket corners permits the gasket 12 to creep in response to the pressure of the panel onto the sealing surface of the gasket can be understood from FIGS. 2 and 4. In FIG. 2, the sides of the panel press against the seal surface 13 of the gasket 12 at points A and B. As shown in FIG. 4, points A, A′ and B, B′ indicate the corners of the panel 14 in contact with the surface 13 of the gasket 12. With the corners 22 of the outer lip 18 of the gasket 12 removed, the pressure of a panel 14 acting on the seal surface 13 of the gasket 12 permits the corners A, A′ and B, B′ to move diagonally outwardly as indicated by the arrows 23. The space D between the seal edge 16 and the seal surface 13 can close even when the curvature space D is rather substantial, e.g. more than 10 mils, because the creeping of the corners allows the gasket material to stretch and move outwardly in the proximity of the corners of the gasket. In the prior art, the corners are not removed from the outer lip 18 of the gasket 12 and the lip material extending around the curved corners prevents the diagonal creep motion from occurring and the gasket material bunches and prevents a good seal between the panel edge and the sealing surface of the gasket from forming. Panels having a curvature exceeding approximately 10 mils typically do not properly seal preventing an adequate vacuum from being formed. Some, or all, of the vaporized aluminum is thus oxidized and the oxidized aluminum causes discoloration of the aluminized layer on the screen, frequently resulting in the rejection of the panel.

What is claimed is:

1. In a resilient, non-porous gasket for a substantially rectangular vacuum chamber having corners, said gasket having an inner lip for protecting the inside surface of a support frame of said vacuum chamber and an outer lip for positioning and holding said gasket on said support frame, said gasket having corners for protecting said corners of said frame, said gasket having a sealing surface for receiving an object having a sealing edge for pressing into and deforming said sealing surface when outside pressure presses on said object during evacuation of said vacuum chamber; an improvement for enabling said gasket to creep during said gasket deformation and for enhancing the sealing of said sealing edge against said sealing surface in the presence of curvature of said sealing edge wherein the corners of said outer lip are removed.

2. The improvement of claim 1 wherein said corners of said support frame are curved and said outer lip corners are removed a slight distance beyond said curved corners.

3. The improvement of claim 2 wherein said gasket includes a guide and shield portion for guiding said object onto said gasket and for shielding said object.

4. The improvement of claim 1 wherein said gasket includes a guide and shield portion for guiding said object onto said gasket and for shielding said object.

* * * * *